US008131187B2

(12) United States Patent
Uno

(10) Patent No.: US 8,131,187 B2
(45) Date of Patent: Mar. 6, 2012

(54) DEVELOPMENT DEVICE, IMAGE FORMING APPARATUS INCLUDING THE SAME, AND METHOD OF REMOVING DEVELOPER THEREFROM

(75) Inventor: Mugijirou Uno, Isehara (JP)

(73) Assignee: Ricoh Company, Limited, Tokyo (JP)

( * ) Notice: Subject to any disclaimer, the term of this patent is extended or adjusted under 35 U.S.C. 154(b) by 360 days.

(21) Appl. No.: 12/535,075

(22) Filed: Aug. 4, 2009

(65) Prior Publication Data

US 2010/0040391 A1 Feb. 18, 2010

(30) Foreign Application Priority Data

Aug. 12, 2008 (JP) ..... 2008-207701

(51) Int. Cl.
*G03G 15/08* (2006.01)

(52) U.S. Cl. ..... 399/257; 399/260; 399/262; 399/263

(58) Field of Classification Search ..... 399/257, 399/260, 262, 263
See application file for complete search history.

(56) References Cited

U.S. PATENT DOCUMENTS

| | | | | |
|---|---|---|---|---|
| 7,280,773 | B2 | 10/2007 | Uno | |
| 2007/0116494 | A1 | 5/2007 | Uno et al. | |
| 2007/0253720 | A1 * | 11/2007 | Kasai | 399/254 |
| 2007/0280742 | A1 | 12/2007 | Matsumoto et al. | |
| 2008/0063434 | A1 | 3/2008 | Uno et al. | |
| 2008/0175628 | A1 | 7/2008 | Kita et al. | |
| 2008/0181630 | A1 | 7/2008 | Matsumoto et al. | |
| 2008/0181670 | A1 | 7/2008 | Tsuda et al. | |
| 2008/0310865 | A1 | 12/2008 | Uno et al. | |
| 2009/0016777 | A1 | 1/2009 | Miyamoto et al. | |
| 2009/0041508 | A1 | 2/2009 | Oshikawa et al. | |
| 2009/0103935 | A1 | 4/2009 | Uno et al. | |
| 2009/0110425 | A1 | 4/2009 | Uno et al. | |
| 2009/0180813 | A1 | 7/2009 | Yoneda et al. | |

FOREIGN PATENT DOCUMENTS

| | | |
|---|---|---|
| JP | 3-9389 | 1/1991 |
| JP | 6-230668 | 8/1994 |
| JP | 11-272062 | 10/1999 |
| JP | 2001-117365 | 4/2001 |

OTHER PUBLICATIONS

U.S. Appl. No. 12/362,897, filed Jan. 30, 2009, Mugijirou Uno.

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

A development device includes a developer carrier facing an image carrier, a first developer transport path and a second developer transport path disposed vertically, a closably openable developer discharge port provided in the second developer transport path, a detector to detect whether the developer carrier carries the developer, a driving unit to drive the first and the second transporters, and a controller. The first developer transport path and the second developer transport path include a first transporter and a second transporter, respectively, to transport the developer in a longitudinal direction. The controller starts rotating the developer carrier and the first transporter and the second transporter in normal directions and opens the developer discharge port simultaneously. When a predetermined time period has elapsed after determining that no developer is carried on the developer carrier, the controller starts rotating the first transporter and the second transporter in reverse.

17 Claims, 6 Drawing Sheets

DEVELOPMENT DEVICE, IMAGE FORMING APPARATUS INCLUDING THE SAME, AND METHOD OF REMOVING DEVELOPER THEREFROM

CROSS-REFERENCE TO RELATED APPLICATIONS

This patent specification claims priority from Japanese Patent Application No. 2008-207701, filed on Aug. 12, 2008 in the Japan Patent Office, which is hereby incorporated by reference herein in its entirety.

BACKGROUND OF THE INVENTION

1. Field of the Invention

The present invention generally relates to an image forming apparatus, such as a copier, a printer, a facsimile machine, or a multifunction device, that includes a development device.

2. Discussion of the Background Art

In general, electrophotographic image forming apparatuses, such as copiers, printers, facsimile machines, or multifunction devices including at least two of those functions, include an image carrier on which an electrostatic latent image is formed, a development device to develop the latent image with developer, and a transfer unit to transfer the developed image from the image carrier onto a sheet of recording media.

The development device is a mechanism that typically includes a developer carrier (developing sleeve) on which the developer is carried, a developer circulation path (developer transport path) in which the developer is circulated, and a developer transporter (e.g., a screw) to transport the developer in the development device.

As the developer, two-component developer including toner and carrier is widely used. It is to be noted that the term "two-component developer" also refers to developer including an additive and the like in addition to the toner and the carrier. The developer should be replaced as the toner is consumed and the carrier deteriorates over time, and various approaches described below have been advanced to remove the deteriorated developer (that is, used developer) from the development device automatically during maintenance work or the like. More specifically, when the developer is replaced, the development device is driven while being set on the image forming apparatus to discharge the used developer therefrom, after which the development device is filled with fresh developer.

In a known development device, to replace the developer, the used developer is carried on the developing sleeve, and a regulator that contacts the developing sleeve scrapes the developer off from the developer sleeve and into a container.

In another known development device, the developer circulation path includes a developer discharge port that is openably closable with a shutter that, when opened, enables the used developer to be discharged from the development device through the developer discharge port.

In yet another known development device, the developer discharge port is disposed close to the developer circulation path. The used developer is discharged from the development device through the developer discharge port while a developer transport screw is rotated in both a normal direction and a reverse direction.

However, in the known development devices described above, when multiple developer transport paths (e.g., an upper transport path and a lower transport path) are arranged vertically to circulate the developer within the development device in an axial, longitudinal direction of the development device, the developer tends to accumulate in a downstream portion in the lower transport path in a direction in which the developer is circulated (hereinafter "developer transport direction"), and cannot be fully removed from the development device.

More specifically, the developer accumulated in the downstream portion of the lower transport path in the developer transport direction is pushed up to an upstream portion of the upper transport path. If the openably closable developer discharge port is disposed in the lower developer transport path, when the amount of the developer in the development device decreases as the used developer is discharged through the developer discharge port, the developer remains in a portion between the developer discharge port and the downstream portion of the lower transport path while it is not transported from the lower transport path to the upper transport path. While the developer in the lower transport path is not sent to the upper transport path, because the developer is packed in the downstream portion of the lower transport path with the transport force of the developer transporter, the developer coagulates. That is, after the automatic removal of the developer is finished, the coagulated toner remains in the development device, which is undesirable. In particular, if unused toner is added to the development device including the toner coagulation and then image formation is performed, it is possible that output images include the coagulated toner, that is, image failure occurs.

In view of the foregoing, there is a need for a simple and effective way to remove the toner fully from the development device during automatic removal of the developer, which the known development devices fail to do.

SUMMARY OF THE INVENTION

In view of the foregoing, one illustrative embodiment of the present invention provides a development device to develop an electrostatic latent image formed on an image carrier.

The development device includes a developer carrier on which developer is carried, disposed facing the image carrier, a first developer transport path including a first transporter, a second developer transport path that is disposed beneath the first developer transport path and includes a second transporter, a closably openable developer discharge port provided in the second developer transport path, through which the developer is removed from the development device, a detector to detect whether or not the developer carrier carries the developer, a driving unit to drive the first transporter and the second transporter in both normal and reverse directions, and a controller. The first transporter and the second transporter transport the developer in a longitudinal direction of the development device. The controller starts rotating the developer carrier as well as the first transporter and the second transporter in normal directions thereof and simultaneously opens the developer discharge port, thus discharging the developer therethrough from the development device. The controller determines that no developer is carried on the developer carrier based on a detection result generated by the detector. When a predetermined time period has elapsed after determining that no developer is carried on the developer carrier, the controller starts rotating the first transporter and the second transporter in reverse.

In another illustrative embodiment of the present embodiment, an image forming apparatus includes an image carrier on which an electrostatic latent image is formed, and the development device described above.

Yet another illustrative embodiment of the present embodiment provides a method of removing the developer from the development device described above.

The method includes rotating the developer carrier as well as the first transporter and the second transporter in normal directions thereof, opening the developer discharge port to remove the developer from the development device, determining whether or not the developer is carried on the developer carrier, and rotating the first transporter and the second transporter in reverse when a predetermined time period has elapsed after it is determined that the developer carrier is carrying no developer thereon.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
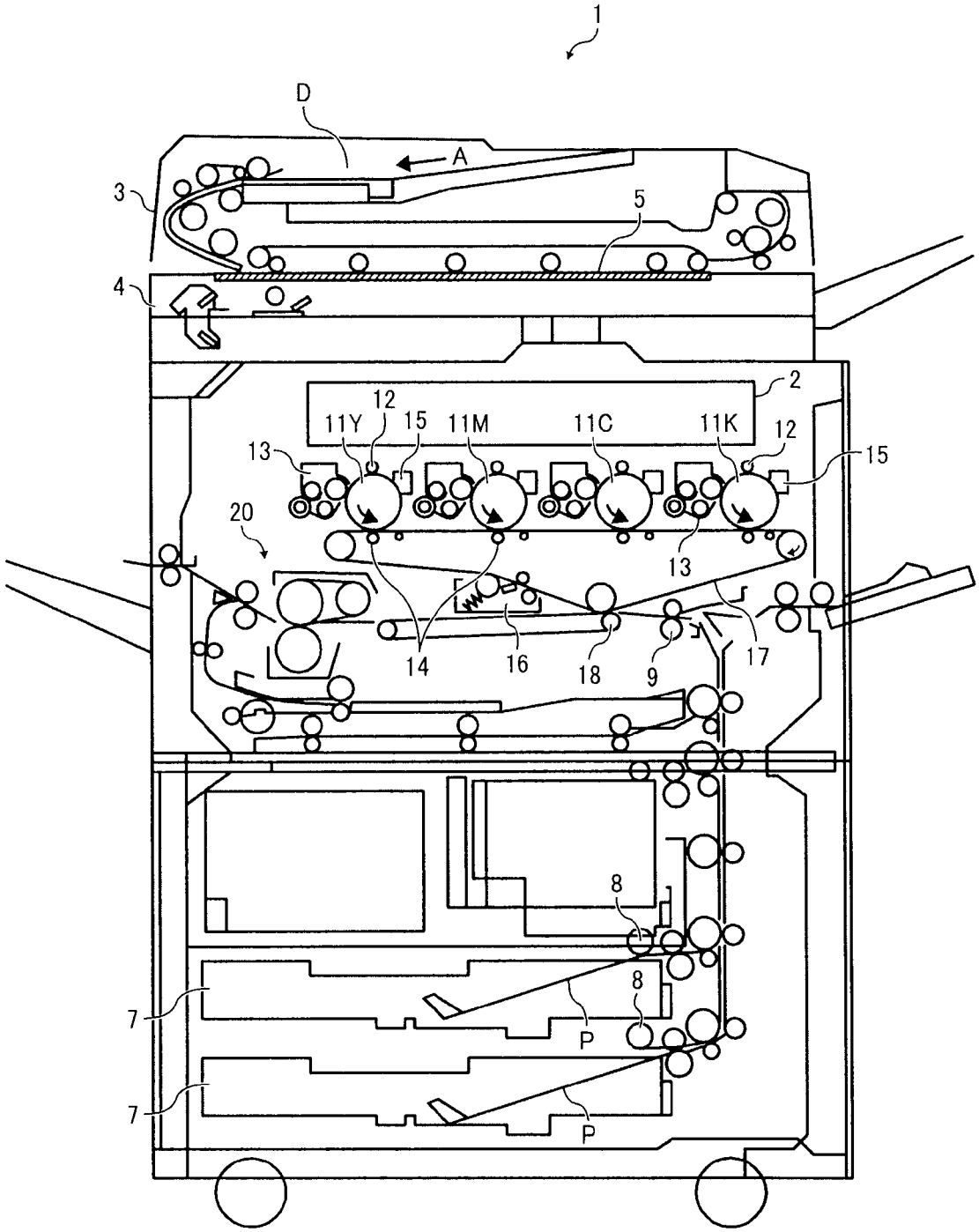
FIG. 1 illustrates a configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an illustrative embodiment of the present invention is described.

With reference to FIG. 1, a configuration and operation of an overall image forming apparatus will be first described. In FIG. 1, a reference numeral 1 denotes a tandem-type multicolor copier functioning as an image forming apparatus (hereinafter referred to as the image forming apparatus 1). The image forming apparatus 1 includes a writing unit 2 for emitting laser light based on image data, a document feeder 3 for conveying a document D onto a contact glass 5, a document reading unit 4 for reading the image data of the document D conveyed by the document feeder 3, and sheet cassettes 7 for storing sheets P (transfer sheet) of recording media such as paper, overhead projector (OHP) film, and the like.

The image forming apparatus 1 further includes a pair of registration rollers 9 for adjusting the timing of conveying the sheet P, and four image forming units including photoconductor drums 11Y, 11M, 11C, and 11BK, on which yellow (Y), magenta (M), cyan (C), and black (BK) toner images are formed, respectively.

It is to be noted that the subscripts Y, M, C, and BK attached to the end of each reference numeral indicate that components indicated thereby are used for forming yellow, magenta, cyan, and black images, respectively, and hereinafter may be omitted when color discrimination is not necessary.

Each of the image forming unit includes, in addition to the photoconductor drum 11, a charging unit 12 for charging a surface of the photoconductor drum 11, a development device 13 for developing an electrostatic latent images formed on the photoconductor drum 11 into a single-color toner image, a primary transfer bias roller 14 for transferring the toner images formed on the photoconductor drum 11 onto an intermediate trans belt 17, and a cleaning unit 15 for removing any tone (hereinafter also "untransferred toner") remaining on the photoconductor drum 11 after the toner image is transferred from the photoconductor drum 11.

The toner images transferred from the respective photoconductor drums 11 by the primary transfer bias rollers 14 are superimposed one on another on the intermediate transfer belt 17, thus forming a multicolor toner image.

The image forming apparatus 1 further includes a belt cleaning unit 16 for cleaning the intermediate transfer belt 17, a secondary transfer bias roller 18 for transferring the multicolor toner image from the intermediate transfer belt 17 onto the sheet P, a fixing device 20 for fixing the unfixed toner image on the sheet P, sheet feeding rollers 8, and so forth.

Although not shown in FIG. 1, the image forming apparatus 1 further includes toner containers 28 (shown in FIG. 2) for storing respective color toners (toner particles) to be supplied to the respective development devices 13, disposed above the respective photoconductor drums 11.

Figure 2:
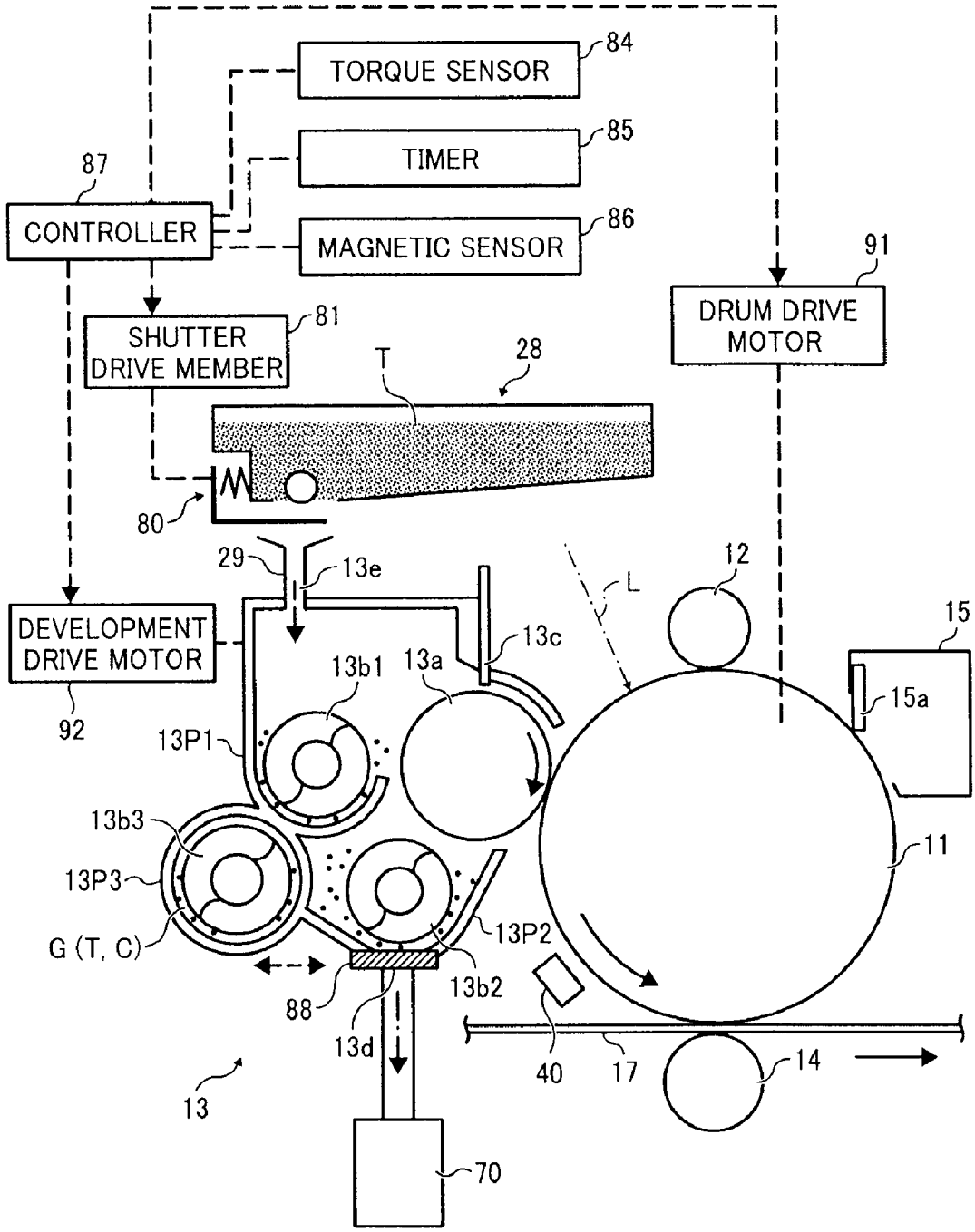
FIG. 2 is an end-on cross-sectional view illustrating a configuration of an image forming unit.

Operations performed in standard multicolor image formation by the image forming apparatus 1 will be described below with reference to FIGS. 1 and 2. FIG. 2 illustrates configurations of the image forming unit and the toner container 28.

Conveyance rollers of the document feeder 3 first convey the document D from a document table in the direction indicated by arrow A shown in FIG. 1, and place the document D on the contact glass 5 of the document reading unit 4. Then, the document reading unit 4 optically reads the image data of the document D on the contact glass 5.

More specifically, the document reading unit 4 scans the image of the document D on the contact glass 5 while directing light emitted from an illumination lamp thereof to the image. Then, the light reflected by the document D forms an image on a color sensor (not illustrated) via multiple mirrors and lenses. Color image data of the documents D is read by the color sensor for each of color-separated lights of RGB (Red, Green, Blue), and is converted into electrical image signals. Further, on the basis of the color-separated image signals of RGB, processing such as color conversion, color correction, and spatial frequency correction is performed by an image processing unit. Thereby, color image data of yellow, magenta, cyan, and black is obtained.

The image data of the respective colors of yellow, magenta, cyan, and black is then transmitted to the writing unit 2. Then, laser lights (i.e., exposure lights) based on the image data of the respective colors are emitted from the writing unit 2 to the respective surfaces of the corresponding photoconductor drums 11Y, 11M, 11C, and 11BK.

Meanwhile, the four photoconductor drums 11Y, 11M, 11C, and 11BK are rotated counterclockwise in FIG. 1.

Referring to FIG. 2, the image forming apparatus 1 further includes a drum drive motor 91 for driving the photoconductor drum 11 that is a driving system separated from a development drive motor 92 serving as a driving unit for driving the development device 13 (e.g., a development roller 13*a*, and transport screws 13*b*1 through 13*b*3). The drum drive motor 91 also drives the charging unit 12 (e.g., charging roller).

In each of the four image forming units, the surface of the photoconductor drum 11 is first uniformly charged at a position facing the charging unit 12. That is, a charging process is performed. Thereby, the surface of the photoconductor drum 11 is charged to a given electrical potential. Thereafter, the charged surface of the photoconductor drum 11 reaches a laser light application position.

In the writing unit 2, the laser lights are emitted from four light sources (not illustrated) corresponding to the respective colors according to the image signals. The four laser lights for yellow, magenta, cyan, and black pass through different optical paths, respectively. That is, an exposure process is performed.

The laser light corresponding to the yellow component is applied to the surface of the photoconductor drum 11Y that is the first from the left in FIG. 1. In this process, the laser light for yellow scans the surface of the photoconductor drum 11Y in the direction of its rotation axis (i.e., main scanning direction), deflected by a polygon mirror (not illustrated) rotating at high speed. Thereby, an electrostatic latent image corresponding to the yellow component is formed on the photoconductor drum 11Y charged by the charging unit 12Y.

Similarly, the laser light for magenta is applied to the surface of the photoconductor drum 11M that is the second from the left in FIG. 1. Thereby, an electrostatic latent image corresponding to the magenta component is formed. Further, the laser light for cyan is applied to the surface of the photoconductor drum 11C that is the third from the left in FIG. 1. Thereby, an electrostatic latent image corresponding to the cyan component is formed. Further, the laser light for black is applied to the surface of the photoconductor drum 11BK that is the first from the right in FIG. 1. Thereby, an electrostatic latent image corresponding to the black component is formed.

Thereafter, the surface of each photoconductor drum 11 carrying the electrostatic latent image reaches a position facing the development device 13. Then, toner of the corresponding color is supplied from the development device 13 to the photoconductor drum 11, developing the latent image thereon into a single-color image. That is, a development process is performed.

Thereafter, the surface of each photoconductor drum 11 reaches a position facing the intermediate transfer belt 17, where the primary transfer bias roller 14 contacts an inner circumferential surface of the intermediate transfer belt 17. Then, at the respective positions of the primary transfer bias rollers 14Y, 14M, 14C, and 14BK, the respective multicolor toner images are sequentially transferred from the photoconductor drums 11Y, 11M, 11C, and 11BK and superimposed one on another on an outer circumferential surface of the intermediate transfer belt 17, thus forming a multicolor toner image. That is, a primary transfer process is performed.

Subsequently, the surface of each photoconductor drum 11 reaches a position facing the cleaning units 15, where the cleaning unit 15 removes the untransferred toner remaining on the photoconductor drum 11. That is, a cleaning process is performed.

Thereafter, the surface of each photoconductor drum 11 passes a discharge lamp (not illustrated) that removes the electrical potential from the photoconductor drum 11. Thus, a sequence of image forming processes on the photoconductor drums 11Y, 11M, 11C, and 11BK is completed.

While the above-described processes are performed, the sheet P is conveyed from one of the sheet cassettes 7 to the pair of registration rollers 9. More specifically, the sheet P stored in the sheet cassette 7 is fed therefrom and conveyed by the corresponding sheet feeding roller 8, guided by a conveyance guide, to the registration rollers 9.

The intermediate transfer belt 17 carrying the multicolor toner moves clockwise in FIG. 1 to a position facing the secondary transfer bias roller 18, that is, a secondary transfer nip where the intermediate transfer belt 17 contacts the secondary transfer bias roller 18.

Then, timed to coincide with the toner image on the intermediate transfer belt 17, the registration rollers 9 forward the sheet P to the secondary transfer nip, and thus the multicolor toner image carried on the intermediate transfer belt 17 is transferred onto the sheet P. That is, a secondary transfer process is performed.

Thereafter, the outer circumferential surface of the intermediate transfer belt 17 reaches a position facing the belt cleaning unit 16. Then, any toner adhering to the surface of the intermediate transfer belt 17 is removed by the belt cleaning unit 16. Thus, a sequence of transfer processes on the intermediate transfer belt 17 is completed.

Then, the sheet P on which the multicolor (full-color) image is transferred is guided into the fixing device 20 by a conveyance belt. In the fixing device 20, the toner image is fixed on the sheet P at a fixing nip where a fixing belt presses against a pressure roller.

Subsequently, the sheet P is discharged outside the image forming apparatus 1 by discharging rollers, as an output image. Thereby, a sequence of image forming processes is completed.

Next, the image forming units and the toner containers 28 are described in further detail below with reference to FIGS. 2 through 4.

Figure 3:
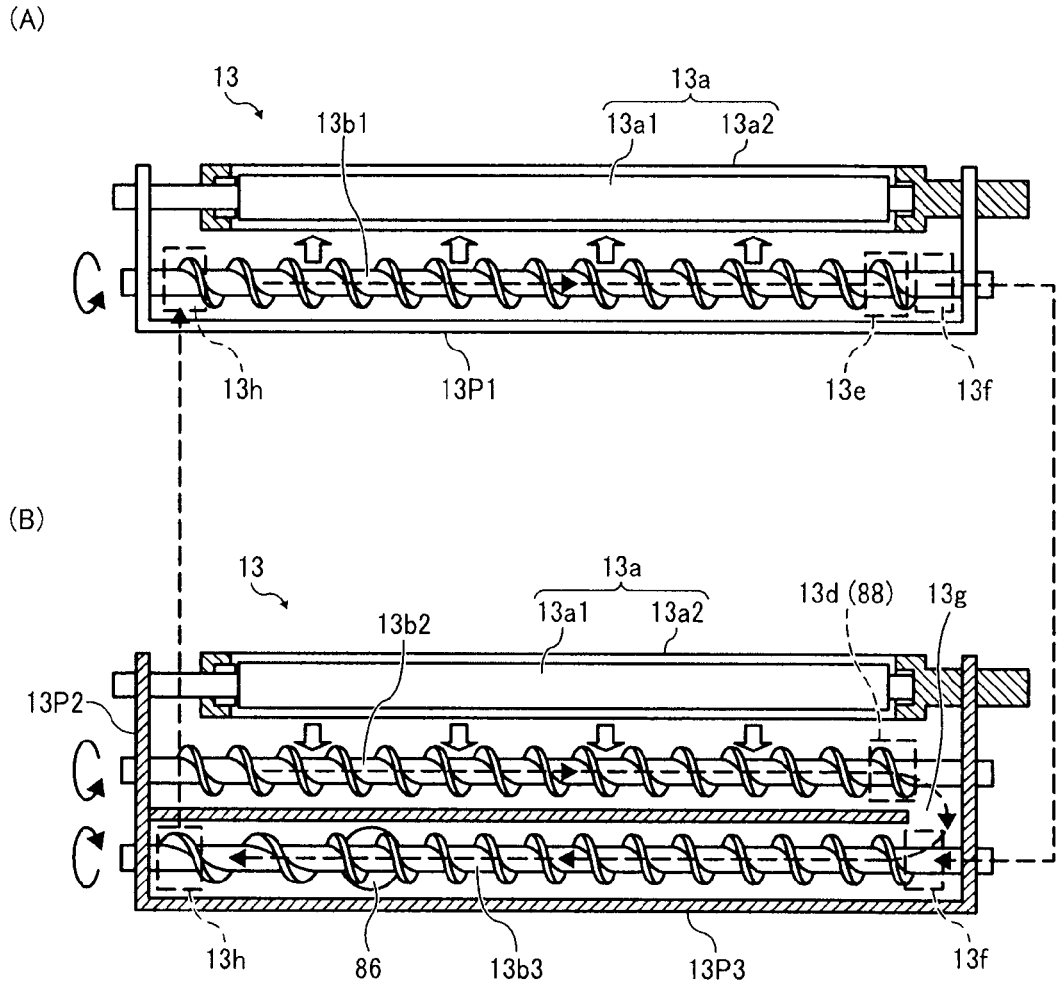
FIG. 3 is a cross-sectional view of a development device viewed along a longitudinal direction, in which (A) illustrates an upper portion thereof and (B) illustrates a lower portion thereof.

In FIG. 3, (A) and (B) are schematic cross-sectional view respectively illustrating an upper portion of the development device 13 in which the transport screw 13*b*1 is disposed, and a lower portion thereof in which the transport screws 13*b*2 and 13*b*3 are disposed, viewed in a longitudinal direction or axial direction of the development device 13. FIG. 4 is an end-on cross-sectional view illustrating an end portion of the development device 13 where a third communicating portion 13*h* is disposed.

It is to be noted that, similarly to the image forming units, the respective toner containers 28 have a similar configuration, and thus the subscripts Y, C, M, and BK are omitted in drawings and the descriptions below.

Referring to FIG. 2, in each image forming unit, the photoconductor drum 11 is an organic photoconductor to be charged to a negative electrical potential and is rotated counterclockwise in FIG. 2 by the drum drive motor 91. An optical sensor 40 is provided to face the photoconductor drum 11. The optical sensor 40 serves as an image density detector to detect image density of the image, that is, a patch pattern that is formed on the photoconductor drum 11 at a predetermined or given timing.

As shown in FIG. 2, the development device 13 further includes a torque sensor 84 to detects a driving torque of the development device 13, and a timer 85 to count a time. Each of the torque sensor 84, the timer 85, and a magnetic sensor 86 (shown in FIG. 3) serves as a detector to detect whether the developer carrier carries the developer and communicates with a controller 87 of the image forming apparatus 1 that controls respective portions of the image forming apparatus 1.

The charging unit 12 in the present embodiment is a charging roller including a metal core, and an elastic layer that overlays the metal core and has a moderate electrical resistivity. In the elastic layer, carbon black as electroconductive particles, sulfurization agent, foaming agent, and the like may be added. Examples of a material of the elastic layer include, but not limited to, urethane, ethylene-propylene-diene monomer (EPDM), acrylonitrile butadiene rubber (NBR), silicone rubber, and isoprene rubber. To adjust its electrical resistivity, an electroconductive material such as carbon black or metal oxide can be dispersed in these rubbers, or these rubbers can be foamed.

The charging unit 12 can be disposed to contact the photoconductor drum 11 or across a given space from the photoconductor drum 11.

The cleaning unit 15 includes a cleaning blade 15*a* that slidingly contacts the photoconductor drum 11 to remove the untransferred toner therefrom mechanically. The cleaning blade 15*a* is formed of rubber such as urethane, EPDM, NBR, silicone, or isoprene. It is to be noted that, although the cleaning blade 15*a* contacts the photoconductor drum 11 in a counter direction in the present embodiment, alternatively, the cleaning blade 15*a* may contact the photoconductor drum 11 in a trailing direction.

As shown in FIG. 2, the development device 13 includes the development roller 13*a* disposed close to the photoconductor drum 11, a doctor blade 13*c*, a supply port 13*e*, and the transport screws 13*b*1 through 13*b*3 that transport two-component developer G including toner T and carrier C inside the development device 13. The transport screws 13*b*1 through 13*b*3 serve as a first transporter, a second transporter, and a third transporter, respectively. The transport screw 13*b*1 is disposed in a transport path 13P1 to face the development roller 13*a*. The transport screw 13*b*2 is disposed in a transport path 13P2, beneath the transport screw 13*b*1, and faces the development roller 13*a*. The transport screw 13*b*3 is disposed in a transport path 13P3, obliquely beneath the transport screw 13*b*1, on a side of the transport screw 13*b*2. The transport paths 13P1 through 13P3 respectively serve as a first developer transport path, a second developer transport path, and a third developer transport path.

It is to be noted, hereinafter "downstream" and "upstream" in the transports path 13P1 through 13P3 mean those in a direction in which the developer G is circulated in the standard development process (hereinafter "developer transport direction").

The development device 13 further includes the magnetic sensor 86 disposed in the transport path 13P3 through which the toner is transported by the transport screw 13*b*3 as shown in (B) of FIG. 3. The magnetic sensor 86 serves as a toner concentration detector to detect the concentration of the toner T, that is, a ratio of the toner T in the developer G circulating in the development device 13.

The development device 13 develops the latent image formed on the photoconductor drum 11 into a toner image with the developer G contained therein. As the toner T in the developer G is consumed in the development process, the unused toner (fresh toner) T is supplied from the toner container 28 to the development device 13.

More specifically, referring to FIG. 2, the toner container 28 includes a shutter 80 and is connected to the development device 13 via a tube 29. The shutter drive unit 81 opens and closes the shutter 80 according to data such as the toner concentration detected by the magnetic sensor 86 or the image density detected by the optical sensor 40, thereby controlling the supply of the toner T from the toner container 28 to the development device 13 via the tube 29 and the supply port 13*e*.

The development roller 13*a* is a cylindrical sleeve formed with a nonmagnetic material such as aluminum, brass, stainless steel, or electrically-conductive resin. The development roller 13*a* is rotated by the development drive motor 92 clockwise in FIG. 2.

Referring to (A) in FIG. 3, the development roller 13*a* includes a sleeve 13*a*2 and a magnet 13*a*1 fixed inside the sleeve 13*a*2, that forms a magnetic field whose force causes the developer G to stand on end on an outer circumferential surface of the sleeve 13*a*2. That is, the carrier particles in the developer G stands one on another like chains on the sleeve 13*a*2 along magnetic force lines in normal directions exerted by the magnet 13*a*1. Then, the charged toner particles adhere to the carrier particles stands one on another on the sleeve 13*a*2, thus forming a magnetic brush. This magnetic brush is transported clockwise as the sleeve 13*a*2 rotates. Then, in a portion where the development roller 13 faces the photoconductor drum 11, the magnetic brush contacts the photoconductor drum 11, and thus a development area is formed.

The doctor blade 13*c* is disposed upstream from the development area and regulates the amount of the developer G carried on the development roller 13*a*.

The transport screws 13*b*1 through 13*b*3 agitate the developer G to mix together the toner T and the carrier C while transporting the developer G in the longitudinal direction of the development device 13, which is perpendicular to the surface of the paper on which FIG. 2 is drawn.

The transport screw 13*b*1 supplies the developer G to the development roller 13*a* as indicated by outlined arrows shown in (A) of FIG. 3 while transporting the developer G through the transport path 13P1 horizontally, which is a direction indicated by a dotted arrow shown in (A) of FIG. 3. Then, as the sleeve 13*a*2 rotates, the developer G carried on the sleeve 13*a*2 passes through the development area. After the development process, the developer G carried on the sleeve 13*a*2 reaches a release pole where the developer G is forcibly removed from the sleeve 13*a*2 as indicated by outlined arrows shown in (B) of FIG. 3. The transport path 13P2 receives the developer G thus removed from the sleeve 13*a*2, and then the transport screw 13*b*2 transports the developer G in the transport path 13P2 horizontally, which is a direction indicated by a dotted arrow shown in (B) of FIG. 3. The transport path 13P2 serves as a developer collection path.

In a downstream portion of the transport path 13P2, the developer G is transported to an upstream portion of the transport path 13P3. The developer G is sent also from a downstream portion of the transport path 13P1 through a first communicating portion 13*f* to the upstream portion in the transport path 13P3. Subsequently, the transport screw 13*b*3 transports both the developer G sent from the transport path 13P2 and that sent from the transport path 13P1 through the transport path 13P3 in a direction indicated by dotted line shown in (B) of FIG. 3, which is opposite the direction in which the transport screw 13*b*2 transports the developer G. Then, the developer G is sent from a downstream portion of the transport path 13P3 to an upstream portion of the transport path 13*b*1.

The three transport screws 13*b*1 through 13*b*3 are aligned so that their rotational axes are substantially horizontal, similarly to the development roller 13*a* and the photoconductor drum 11. The development roller 13*a* and the transport screws 13*b*1 through 13*b*3 are driven by the development drive motor 92 via gears, not shown.

The development drive motor 92 can drive the development roller 13 and the transport screws 13*b*1 through 13*b*3 in both their normal directions and their reverse directions. During the development process and a period from the start of removal of the developer G (hereinafter "developer removal") from the development device 13 and just before the completion thereof, the development drive motor 92 drives the development roller 13 and the transport screws 13*b*1 through 13*b*3 in the normal directions, which is indicated by arrows in FIGS. 2 and 3. By contrast, at the end of the developer removal, the development drive motor 92 drives the development roller 13 and the transport screws 13*b*1 through 13*b*3 in the reverse directions.

It is to be noted that, although the transport paths 13P1 through 13B3 are divided with walls from each other, as shown in (B) of FIG. 3, the downstream portion of the transport path 13P2 communicates with the upstream portion of the transport path 13P3 through a second communicating portion 13*g*. Similarly, as shown in FIG. 3, the downstream portion of the transport path 13P1 communicates with the upstream portion of the transport path 13P3 through the first communicating portion 13*f*, and the downstream portion of the transport path 13P3 communicates with the upstream portion of the transport path 13P1 through the communicating portion 13*h*.

Figure 4:
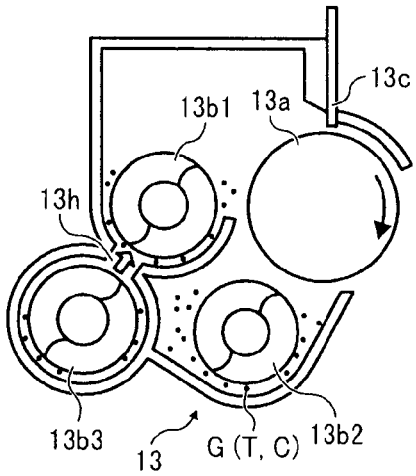
FIG. 4 is an end-on cross-sectional view illustrating an end portion of the development device.

Referring to FIG. 4, in the transport path 13P3, the developer G accommodates at a portion close the third communicating portion 13*h* and then sent to the upstream portion of the transport path 13P1 through the third communicating portion 13*h*.

Thus, the transport paths 13P1 through 13P3 form a developer circulation path through which the developer G is circulated in the longitudinal direction inside the development device 13. In other words, when the development drive motor 92 drives the development device 13, the development roller 13*a* and the three transports screws 13*b*1 through 13*b*3 rotate in the respective normal directions. Then, the developer G is transported through the development device 13 in the directions indicated by arrows shown in FIG. 3. As the developer supply path (transport path 13P1) is separated from the developer collection path (transport path 13P2) in the present embodiment, differences in the image density of the toner image formed on the photoconductor drum 11 can be reduced.

As shown in (B) of FIG. 3, the magnetic sensor 86 is disposed on a downstream side of the transport path 13P3 and detects the concentration of the toner T in the developer G. A predetermined or given amount of the toner T is supplied from the toner container 28 to the development device 13 according to the toner concentration detected by the magnetic sensor 86 or the image density detected by the optical sensor 40.

Additionally, referring to (B) of FIG. 3, the development device 13 includes a developer discharge port 13*d* disposed in a bottom portion on the downstream side of the transport path 13P2 and a shutter 88 that opens and closes the developer discharge port 13*d*. Further, a container 70 to store the developer G removed from the development device 13 is provided outside the development device 13.

When the used developer G is not discharged through the developer discharge port 13*d*, the shutter 88 closes the developer discharge port 13*d* as shown in FIG. 2. By contrast, when the developer G is replaced, the shutter 88 moves to open the developer discharge port 13*d*. Then, the development drive motor 92 drives the development device 13 to discharge the developer G that has reached the developer discharge port 13*d* while circulating the developer G therein. The discharged developer G then flows down with its own weight and is collected in the container 70.

Thus, in the present embodiment, the developer discharge port 13*d* and the shutter 88 together form a developer discharge unit that discharges (removes) the developer G from the development device 13 while the development roller 13 and the transport screws 13*b*1 through 13*b*3 are driven. Therefore, the deteriorated developer G can be automatically removed from the development device 13 with a relatively simple configuration in a simple operation.

It is to be noted that, although the supply port 13*e* and the developer discharge port 13*d* are respectively disposed in the transport path 13P1 through which the transport screw 13*b*1 transports the developer G and the transport path 13*b*2 through which the transport screw 13*b*2 transports the developer G in the present embodiment, their positions are not limited thereto.

Descriptions will be made below of a disengagement mechanism to disengage the intermediate transfer belt 17 from the photoconductor drums 11 and engage the intermediate transfer belt 17 therewith with reference to FIGS. 5 and 6.

Figure 5:
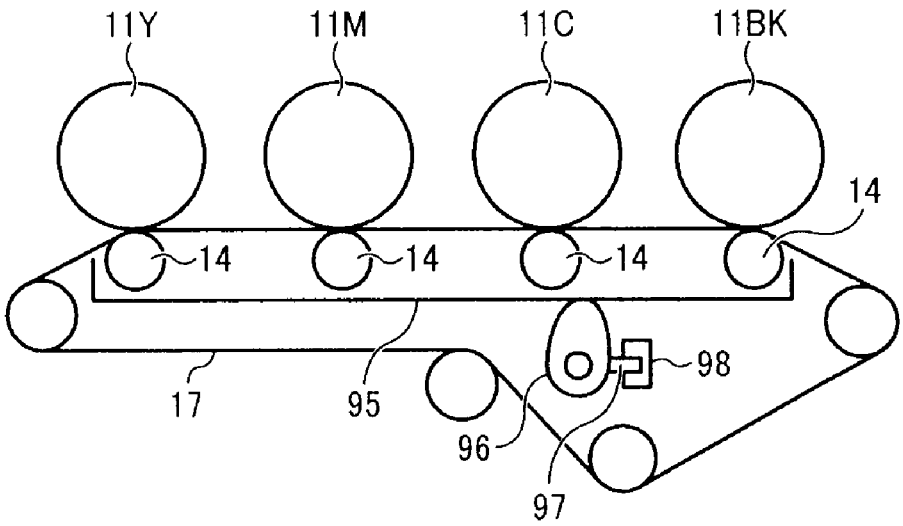
FIG. 5 is a schematic view illustrating a configuration around an intermediate transfer belt.
Figure 6:
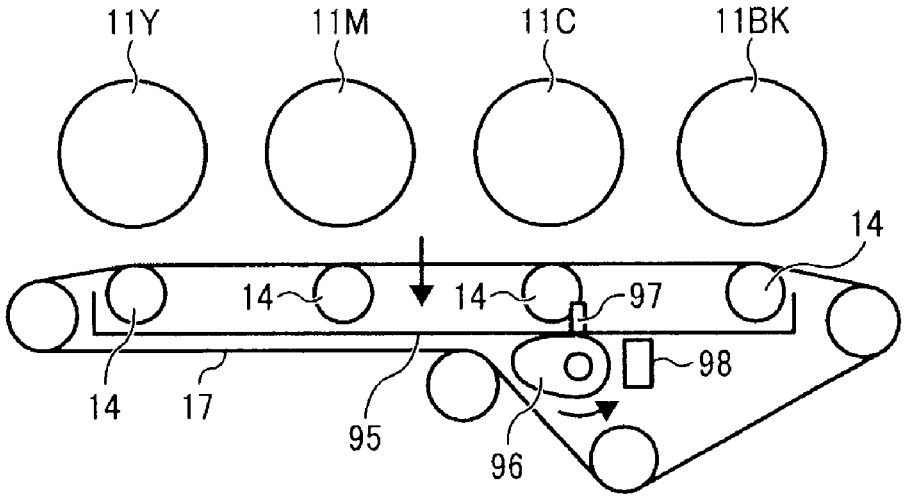
FIG. 6 is a schematic view illustrating a state in which the intermediate transfer belt is disengaged from photoconductor drums.

Referring to FIGS. 5 and 6, the intermediate transfer belt 17 is a contact member that is engaged with and disengaged from the photoconductor drums 11. More specifically, the primary transfer bias roller 14 that contact the inner circumferential surface of the intermediate transfer belt 17 are rotatably held by a holder 95. The holder 95 is held by a housing that supports the intermediate transfer belt 17 and is movable vertically via a cam 96.

With this configuration, when a motor, not shown, rotates the cam 96 a predetermined or given degrees, the intermediate transfer belt 17 is moved to contact or away from the photoconductor drums 11. More specifically, during the standard image formation, the cam 96 is at an engagement position shown in FIG. 5, and thus the intermediate transfer belt 17 engages the photoconductor drums 11. By contrast, during the developer removal, the cam 96 is at a disengagement position shown in FIG. 6, and thus the intermediate transfer belt 17 is disengaged from the photoconductor drums 11.

Herein, in the present embodiment, a position detector 98 to detect the rotational position of the cam 96 is provided close to the cam 96, and a detected plate 97 is attached to the cam 96. The position detector 98 in the present embodiment is a photosensor including a light-emitting element and a light-receiving element that is disposed at a space from the light-emitting element. The position detector 98 serves as a detector to detect that the intermediate transfer belt 17 is disengaged from the photoconductor drums 11 (hereinafter "disengagement state of the intermediate transfer belt 17").

When the detected plate 97 attached to the cam 96 is between the light-emitting element and the light-receiving element as shown in FIG. 5, the light emitted from the light-emitting element is blocked by the detected plate 97 and does not reach the light-receiving element. Thus, based on an output value of the light-receiving element of the position detector 98, the controller 87 shown in FIG. 2 determines that the cam 96 is at the engagement position to engage the intermediate transfer belt 17 with the photoconductor drums 11. That is, it is determined that the intermediate transfer belt 17 engages with the photoconductor drums 11.

By contrast, when the detected plate 97 attached to the cam 96 is not between the light-emitting element and the light-receiving element of the position detector 98 as shown in FIG. 6, the light emitted from the light-emitting element reaches the light-receiving element. Then, based on an output value of the light-receiving element, the controller 87 shown in FIG. 2 determines that the cam 96 is at the disengagement position to disengage the intermediate transfer belt 17 from the photoconductor drums 11, that is, the intermediate transfer belt 17 is away from the photoconductor drums 11.

Descriptions will be made below of control performed when the developer is removed from the development device 13 and stored in the container 70 (automatic developer removal).

Figure 7:
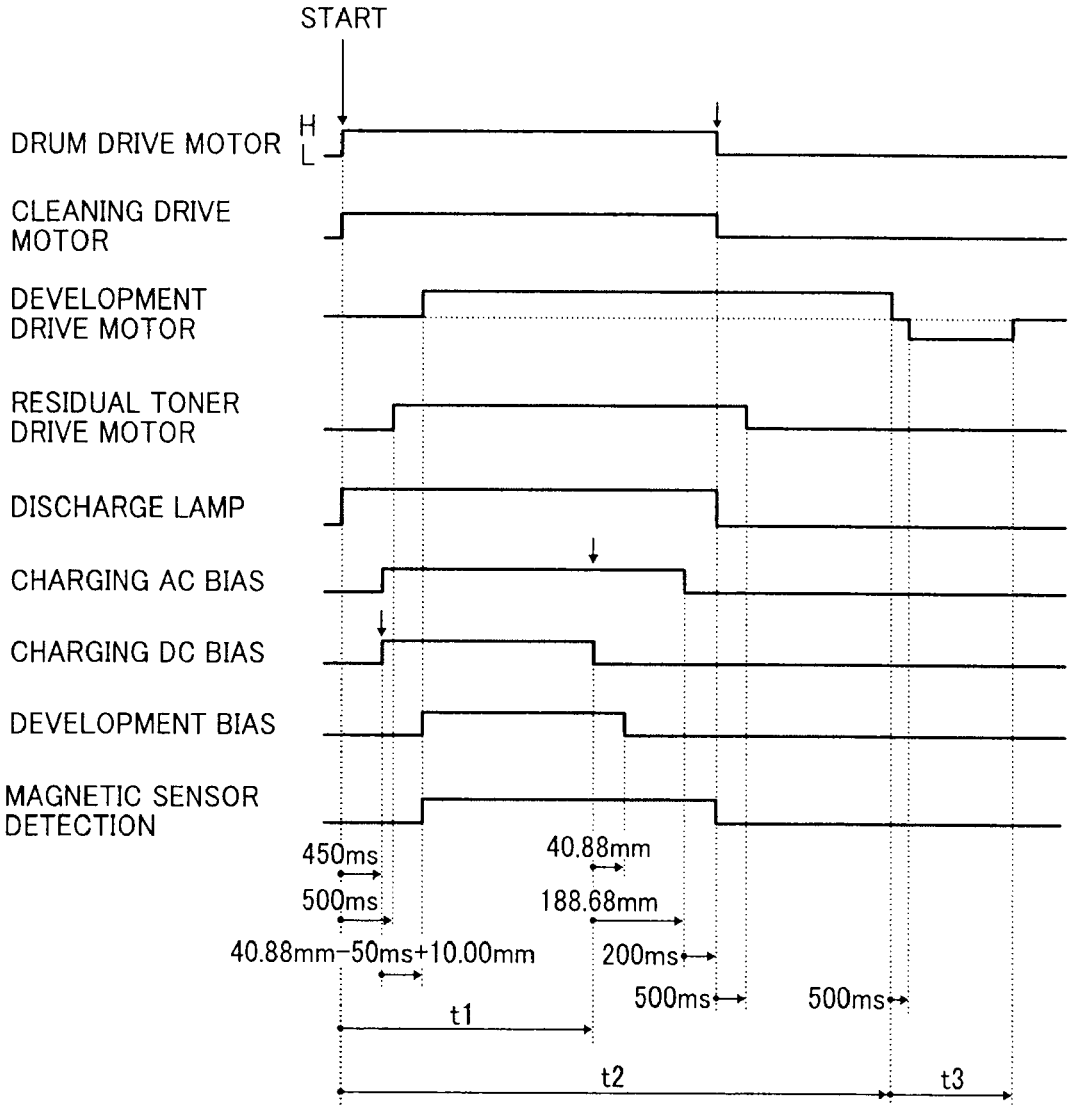
FIG. 7 is a timing chart illustrating the temporal relations among operations performed in automatic developer removal.

FIG. 7 is a timing chart illustrating the temporal relations among operations performed in the automatic developer removal.

Referring to FIGS. 2 and 7, while the development device 13 is attached to the image forming apparatus 1, a service person or user presses a button, not shown, for the automatic developer removal in a control panel, not shown, of the image forming apparatus 1. Then, the controller 87 causes the drum drive motor 91 to rotate the photoconductor drums 11 and the charging units 12. Simultaneously, a motor, not shown, starts driving the cleaning unit 15, and the discharge lamp, not shown, is turned on. This state is maintained until the rotation of each photoconductor drum 11 becomes stable.

Subsequently, an charging AC (Alternating Current) bias and a charging DC (Direct Current) bias are applied to each photoconductor drum 11, and thus the surface of the photoconductor drum 11 is charged to the predetermined potential. When the charged surface of the photoconductor drum 11 reaches the position facing the development roller 13*a*, the controller 87 causes the development drive motor 92 to rotate the development roller 13*a* and the transport screws 13*b*1 through 13*b*3 in the respective normal directions and starts application of a development bias to the development roller 13*a*. Along with these operations, the shutter 88 opens, thus discharging the developer G from the development device 13.

Thus, in the present embodiment, at the start of the automatic developer removal, that is, when the removal of the developer from the development device 13 has not yet advanced and the development roller 13*a* carries a sufficient amount of developer, the development device 13 is driven while each photoconductor drum 11 is rotated. The photoconductor drum 11 is kept rotating until the amount of the developer supplied to the photoconductor drum 11 decrease to zero or almost zero. Therefore, it can be avoided that the developer carried on the development roller 13*a* contacts only a limited area of the photoconductor drum 11 that is motionless, which can damage the surface of the photoconductor drum 11. Thus, scratches extending in the axial direction or the like on the photoconductor drums 11 can be prevented or reduced.

As the removal of the developer through the developer discharge port 13*d* advances, the developer (residual developer) remaining in the development device 13 decreases, and accordingly only a small amount of developer is carried on the development roller 13. More specifically, the height (amount) of the developer in the development device 13 decreases from the downstream side of the transport path 13P1 gradually to close zero. Then, the amount of developer received by the development roller 13*a* decreases as its position closes the right in FIG. 3, that is, closes a downstream end in the direction in which the developer is transported by the transport screw 13*b*1. Finally, the development roller 13*a* does not receive the developer across its entire length in the longitudinal direction.

In the present embodiment, when the developer is no longer carried on the development roller 13*a*, the photoconductor drum 11 is stopped. That is, the photoconductor drum 11 is stopped when the cleaning blade 15*a* no longer receives the toner.

If the photoconductor drum 11 is rotated for a relatively long time period in a state in which no toner contacts an edge portion (contact portion) of the cleaning blade 15*a*, the cleaning blade 15*a* can curl and be damaged. Therefore, by stopping the photoconductor drum 11 when the mount of the developer carried on the development roller 13*a* has decreased to zero or almost zero as described above, such an inconvenience can be prevented.

Thus, the above-described control can prevent or reduce damage to the cleaning blade 15*a* as well as the photoconductor drum 11, and accordingly, secondary malfunction of the image forming apparatus 1 such as cleaning failure, abnormal noises, or the like can be prevented or reduced.

It is to be noted that the rotation of the photoconductor drum 11 should be stopped when the photoconductor drum 11 has rotated 360 degrees or greater after the application of the charging DC bias is stopped, that is, the electrical potential has removed from its surface entirely. In this time period, the application of the development bias and the charging AC bias are also stopped, and the discharge lamp is turned off.

Even after the rotation of the photoconductor drum 11 is stopped, the development device 13 keeps to operate until the developer is fully removed therefrom.

Further, in the present embodiment, after a predetermined time period has elapsed after the controller 87 determines that no developer is carried on the development roller 13*a*, the development drive motor 92 is rotated in reverse, causing the development roller 13*a* and the three transport screws 13*b*1 through 13*b*3 to rotate in their reverse directions.

The temporal relations among the above-described operations are as follows.

When the developer is removed from the development device 13, initially the driving of the photoconductor drum 11 is started. Then, the driving of the development device 13 is started, that is, the development roller 13*a* and the three transport screws 13*b*1 through 13*b*3 start rotating in their normal directions, and simultaneously, the developer discharge port 13*d* is opened, thus discharging the developer therethrough.

Subsequently, the photoconductor drum 11 is stopped when the controller 87 determines that no developer is carried on the development roller 13*a*. After a predetermined time period has elapsed after the controller 87 determines that no developer is carried on the development roller 13*a*, the development drive motor 92 is rotated in reverse, thus starting the reverse rotation of the development roller 13*a* and the three transport screws 13*b*1 through 13*b*3. After a predetermined time period has elapsed after the start of the reverse rotation of the development roller 13*a* and the three transport screws 13*b*1 through 13*b*3, the developer discharge port 13*d* is closed, and thus the removal of the developer is completed.

By driving the development device 13 in the normal direction (direction of the standard development process) from the start of the automatic developer removal to just before the completion of the automatic developer removal and in the reverse direction just before the completion of the automatic developer removal as described above, the developer can be fully removed from the development device 13, which is described in detail below with reference to FIGS. 2 and 3.

While the development device 13 is driven in the normal direction, similarly to the standard development process, the developer G accumulates in the downstream portion, in the developer transport direction, of the transport path 13P3 (third developer transport path) disposed beneath the transport path 13P1 (first developer transport path), and the accumulated developer G is then pushed to reach the upstream portion of the transport path 13P1. Then, the developer G is circulated through the developer circulation path to the downstream portion of the transport path 13P2 and discharged through the developer discharge port 13*d* provided in the downstream portion of the transport path 13P2.

As the removal of the developer G advances, the amount of the residual developer G in the development device 13 decreases. In this state, the developer G is not sent from the lower transport path 13P3 to the upper transport path 13P1 through the third communicating portion 13*h* and the developer G remains in a portion between the downstream portion of the transport path 13P3 and the developer discharge port 13*d*.

If the development device 13 is kept driven in the normal direction, the residual developer in the transport path 13P3 is packed in the downstream portion of the transport path 13P3 with the transport force of the transport screw 13*b*3, resulting in coagulation of the developer G as described above. Thus, after the automatic developer removal is finished, the toner coagulation can remain in the development device 13.

Therefore, in the present embodiment, the transport screws 13*b*1 through 13*b*3 are rotated in reverse just before the end of the automatic developer removal to transport the residual developer in the transport path 13P3 to the right in (B) in FIG. 3. Then, the developer G is sent through the first communicating portion 13*f* to the transport path 13P2 and is transported to the left with the reverse rotation of the transport screw 13*b*2 to the developer discharge port 13*d*. Thus, the residual developer G can be removed from the development device 13.

Herein, before the reverse driving of the development device 13 is started, a sufficient time is secured for the developer G in the first transport path 13P1 and in the portion between the upstream portion and the developer discharge port 13*d* in the second transport path 13P2 to be discharged through the developer discharge port 13*d*. Therefore, when the development device 13 is driven in reverse, only the developer G remaining in the portion between the downstream portion of the transport path 13P3 and the developer discharge port 13*d* is discharged through the developer discharge port 13*d*. Thus, the developer G can be fully removed from the development device 13.

Next, the determination of whether or not the developer is carried on the development roller 13*a* is described below.

The timer 85 shown in FIG. 2 can be used as the detector to detect whether or not the developer is carried on the development roller 13*a*. The timer 85 counts the time from the start of the automatic developer removal.

More specifically, the controller 87 can deem that the developer is no longer carried on the development roller 13*a* when the time counted by the timer 85 reaches a predetermined or given count after the automatic developer removal, that is, the driving of the photoconductor drum 11, is started. Thus, the controller 87 determines that no developer is carried on the development roller 13*a* based on the detection result generated by the timer 85 serving as the detector and then stops the photoconductor drum 11. The timer 85 also counts the time after the photoconductor drum 11 is stopped. When the time counted by the timer 85 reaches a predetermined or given count, that is, a predetermined time A has elapsed, after the stop of the photoconductor drum 11, the development drive motor 92 is driven in reverse, thus driving the development device 13 in reverse.

It is to be noted the predetermined time period after the automatic developer removal is started and that after the photoconductor drum 11 is stopped are decided through test runs in advance.

Because the image forming apparatus 1 originally includes the timer 85 for various control operations thereof, it is not necessary to add a dedicated timer to detect whether or not the development roller 13*a* carries the developer.

Alternatively, the magnetic sensor 86 shown in FIG. 2 can be used as the detector to detect whether or not the developer is carried on the development roller 13*a*. The magnetic sensor 86 functions as the toner concentration detector to detect the concentration of the toner in the developer based on changes in the magnetic permeability of the developer. By detecting changes in the magnetic permeability of the developer, decrease in the amount of the developer around the magnetic sensor 86 can be known. Thus, whether the developer is no longer supplied to the development roller 13*a* can be determined based on the magnetic permeability.

More specifically, after the removal of the developer is started, when the permeability detected by the magnetic sensor 86 is at a predetermined value the controller 87 can deem that the developer is no longer carried on the development roller 13*a*. Then, the controller 87 stops the photoconductor drum 11.

It is to be noted the predetermined value is decided through test runs in advance.

Alternatively, when a predetermined time period has elapsed after the permeability detected by the magnetic sensor 86 reaches the predetermined value, it can be determined that the developer is no longer carried on the development roller 13*a*, and then the photoconductor drum 11 can be stopped.

Because the magnetic sensor 86 is used to detect the concentration of the toner in the developer in the development device 13, it is not necessary to add a dedicated detector to detect the development roller 13*a* carries the developer.

Yet alternatively, the torque sensor 84 shown in FIG. 2 can be used as the detector to detect whether the development roller 13*a* carries the developer. The torque sensor 84 detects the driving torque of the development device 13. The torque sensor 84 can be a sensor to detect fluctuation in the electrical current supplied to the development drive motor 92.

More specifically, during the automatic developer removal, the driving torque of the development device 13 decreases as the developer is remove from the development device 13, and accordingly the electrical current value detected by the torque sensor 84 decreases. When the electrical current value detected by the torque sensor 84 decreases to a predetermined or given value after the automatic developer removal is started, the controller 87 shown in FIG. 2 can deem that no or almost no developer is carried on the development roller 13*a*. At that time, the photoconductor drum 11 is stopped.

It is to be noted the predetermined electrical current value is decided through test runs in advance.

Alternatively, when a predetermined time period has elapsed after the electrical current detected by the torque sensor 84 reaches the predetermined value, it can be deemed that the developer is no longer carried on the development roller 13*a*.

Because the torque sensor 84 is used as an abnormal state detector to detect an abnormal increase in the driving torque that is caused by an abnormal state of the development device 13 during image formation, it is not necessary to add a dedicated detector to whether the development roller 13*a* carries the developer.

Yet alternatively, the optical sensor 40 shown in FIG. 2 can be used as the detector to detect whether the developer is carried on the development roller 13*a*. The optical sensor 40 serves as the image density detector to detect the image density of the toner image formed on the photoconductor drum 11. The optical sensor 40 includes a light-emitting element to direct light to the toner image on the photoconductor drum 11 and a light-receiving element to receive the light reflected on the toner image.

More specifically, during the automatic developer removal, the image density of the toner image on the photoconductor drum 11 decreases as the developer is removed from the development device 13. When the image density (detection result) detected by the optical sensor 40 decreases to a predetermined or given value after the automatic developer removal is started, the controller 87 shown in FIG. 2 can deem that no or almost no developer is carried on the development roller 13*a*. At that time, the photoconductor drum 11 is stopped.

The optical sensor 40 is preferably provided in a portion corresponding to the upstream portion in the transport path 13P1 (first developer transport path) because the surface of the developer is lower in the downstream portion in the transport path 13P1 than in the upstream portion therein. Thus, the supply of the developer to the development roller 13*a* from the upstream portion in the transport path 13P1 ends earlier than that from the downstream portion in the transport path 13P1 ends.

It is to be noted the predetermined image density is decided through test runs in advance.

Alternatively, when a predetermined time period has elapsed after the image density detected by the optical sensor 40 decreases to the predetermined value, it can be deemed that the developer is no longer carried on the development roller 13*a*.

By using the optical sensor 40 as the detector to detect whether the developer is carried on the development roller 13*a*, it is not necessary to add a dedicated detector to detect whether the developer is carried on the development roller 13*a*.

Thus, by using the timer 85, the magnetic sensor 86, the torque sensor 86, or the optical sensor 40, whether or not the developer is carried on the development roller 13*a* can be determined without increasing the cost and the number of the components of the image forming apparatus 1.

Herein, in the present embodiment, the above-described automatic developer removal is executed only when the intermediate transfer belt 17 is separated from the photoconductor drums 11 as described above with reference to FIGS. 5 and 6. In other words, the developer discharge port 13*d* and the shutter 88, together forming the developer discharge unit, are driven only when the position detector 98 detects that the cam 96 is at the disengagement position shown in FIG. 6, that is, the intermediate transfer belt 17 is separated from the four photoconductor drums 11.

Thus, when the developer is removed from the development device 13, even when the photoconductor drum 11 is rotated, the photoconductor drum 11 does not slidingly contacts the intermediate transfer belt 17. If the intermediate transfer belt 17 is not disengaged from the photoconductor drum 11, the photoconductor drum 11 slidingly contacts only a limited area of the intermediate transfer belt 17 that is motionless, which can make ribbon-like scratches on the surface of the intermediate transfer belt 17.

Therefore, by separating the intermediate transfer belt 17 from the photoconductor drums 11 when the automatic developer removal is executed, the intermediate transfer belt 17 can be protected from damage. As the intermediate transfer belt 17 is expensive, this operation is effective.

It is to be noted that the detector to detect the disengagement state of the intermediate transfer belt 17 is not limited to the position detector 98.

Alternatively, a drum driving torque sensor to detect the driving torque of the photoconductor drum 11 can be used as the detector to detect the disengagement state of the intermediate transfer belt 17. The drum driving torque sensor detects fluctuation in the electrical current supplied to the drum drive motor 91. Because the amount of the electrical current supplied to the drum drive motor 91 decreases while the intermediate transfer belt 17 is disengaged from the photoconductor drums 11, the drum driving torque sensor can serve as the detector to detect the disengagement state of the intermediate transfer belt 17.

Yet alternatively, a belt position detector to detect a position of the intermediate transfer belt 17 can be used as the detector to detect the disengagement state of the intermediate transfer belt 17. The belt position detector can be a photosensor that optically detects movement of the intermediate transfer belt 17 in the vertical direction.

It is to be noted that when there is another contact member that is engaged with and disengaged from the photoconductor drums 11 other than the intermediate transfer belt 17, the automatic developer removal can be executed only when such contact members are disengaged from the photoconductor drums 11. In this case, such contact members can be protected from damages caused by slidingly contacting the photoconductor drums 11.

Figure 8:
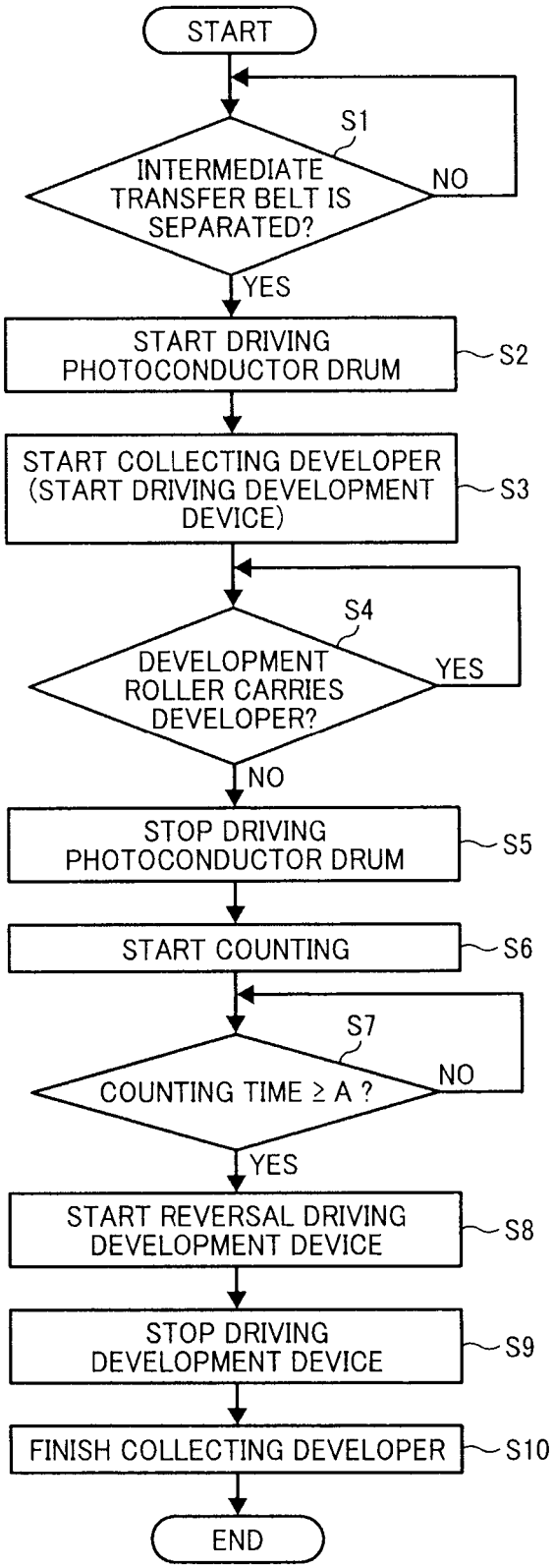
FIG. 8 is a flowchart illustrating a sequence of operations performed in the automatic developer removal.

Descriptions will be made below of a sequence of the operations performed in the automatic developer removal with reference to FIGS. 2 and 8.

When the service person or user presses the button, not shown, for the automatic developer removal in a control panel, not shown, the automatic developer removal (developer collection mode) is started. At S1, the controller 87 determines whether or not the intermediate transfer belt 17 is separated from the photoconductor drums 11. For example, the controller 87 checks whether or not the position detector 98 has transmitted a signal indicating that the intermediate transfer belt 17 is separated from the photoconductor drums 11.

When the controller 87 deems that the intermediate transfer belt 17 is not yet separated from the photoconductor drums 11 (NO at S1), subsequent operations are not performed until the intermediate transfer belt 17 is separated from the photoconductor drums 11.

By contrast, when the controller 87 deems that the intermediate transfer belt 17 is separated from the photoconductor drums 11 (YES at S1), at S2 the driving of the photoconductor drum 11 is started. At S3, the controller 87 causes the development drive motor 92 to drive the development device 13 in the respective normal directions and opens the shutter 88, thus discharging the developer from the development device 13.

After the discharge of the developer through the developer discharge port 13*d* is started, at S4, the detector, that is, the timer 85, the magnetic sensor 86, the torque sensor 84, or the optical sensor 40, checks whether or not the development roller 13*a* still carries the developer. When the controller 87 deems that the development roller 13*a* still carries the developer (YES at S4), subsequent operations are yet not performed. In this state, the photoconductor drum 11 and the development device 13 are kept operating in the normal directions.

By contrast, when the controller 87 deems that the development roller 13*a* no longer carries the developer (NO at S4), at S5 the photoconductor drum 11 is stopped rotating.

At S6, the timer starts counting time after the photoconductor drum 11 is stopped. At S7, the controller 87 checks whether or not the predetermined time A has elapsed after the stop of the photoconductor drum 11. When the predetermined time A has elapsed (YES at S7), at S8 the driving of the development device 13 in the normal direction is stopped, and then the development drive motor 92 is driven in reverse.

After the development device 13 has been driven in reverse for a predetermined or given time period, at S9 the reverse driving of the development device 13 is stopped. At S10 the shutter 88 closes the development discharge port 13*d*, and thus the automatic developer removal is finished.

As described above, in the present embodiment, in the automatic developer removal from the development device 13, initially the development roller 13*a* and the transport screws 13*b*1 through 13*b*3 are driven, and the developer discharge port 13*d* is opened. Then, when the predetermined time period has elapsed after the controller 87 determines that no developer is carried on the development roller 13*a*, the transport screws 13*b*1 through 13*b*3 are driven in reverse. Therefore, although the developer remains between the downstream portion of the third developer transport path 13P3 (lower developer transport path) and the developer discharge port 13*d* while the transport screws 13*b*1 through 13*b*3 are driven in the normal directions, this residual developer can be transported to the developer discharge port 13*d* by the reverse rotation of the transport screws 13*b*1 through 13*b*3. Thus, the developer can be removed from the development device 13 fully or almost fully in the automatic developer removal according to the present embodiment.

It is to be noted that, although the description above concerns the development device including three developer transport paths, the present invention may be applied to any development device that includes at least two developer transport paths arranged vertically, that is, their positions in the vertical direction are different. In other words, the present invention may be applied to any development device that forms a developer circulation path by sending the developer from a lower developer transport path to an upper developer transport path.

In addition, although the description above concerns the configuration in which the development device is detachably attachable to the image forming apparatus in itself, the present invention may applied to image forming apparatuses including an integrated image forming unit that is configured as a process cartridge detachably attachable to the main body thereof. The process cartridge means an integrated unit that includes an image carrier and at least one of a charging unit, a development device, and a cleaning unit, and is detachably attachable to the image forming apparatus.

Needless to say, the present invention may be applied to a monochrome image forming apparatus, a direct-transfer image forming apparatus, and a one-drum type image forming apparatus.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device to develop an electrostatic latent image formed on an image carrier, the development device comprising:

a developer carrier on which developer is carried, disposed facing the image carrier;

a first developer transport path including a first transporter to transport the developer in a longitudinal direction of the development device;

a second developer transport path disposed beneath the first developer transport path, including a second transporter to transport the developer in the longitudinal direction;

a closably openable developer discharge port provided in the second developer transport path, through which the developer is removed from the development device;

a detector to detect whether or not the developer carrier carries the developer;

a driving unit to drive each of the first transporter and the second transporter in both a normal direction and a reverse direction; and a controller, the controller starting rotation of the developer carrier as well as the first transporter and the second transporter in normal directions thereof and opening the developer discharge port to remove the developer from the development device simultaneously, and starting rotation of the first transporter and the second transporter in reverse when a predetermined time period has elapsed after determining that no developer is carried on the developer carrier based on a detection result generated by the detector.

2. The development device according to claim 1, further comprising a third developer transport path that is disposed beneath the first developer transport path, faces the second developer transport path, and includes a third transporter to transport the developer in the longitudinal direction, wherein the first developer transport path faces the developer carrier, and the first transporter supplies the developer to the developer carrier while transporting the developer in the longitudinal direction, the second developer transport path faces the developer carrier, and the second transporter transports the developer received from the developer carrier in the longitudinal direction, the developer discharge port is disposed in a downstream portion of the second developer transport path in a developer transport direction, and the third transporter receives the developer both from a downstream portion of the first developer transport path and from the downstream portion of the second developer transport path in the developer transport direction and transports the developer to an upstream portion of the first developer transport path.

3. The development device according to claim 1, wherein, when the developer is removed from the development device, the controller starts rotating the image carrier before starting the rotation of the developer carrier as well as the first transporter and the second transporter in the normal directions thereof, and the controller stops rotating the image carrier when determining that no developer is carried on the developer carrier based on the detection result generated by the detector.

4. The development device according to claim 1, wherein the detector to detect whether or not the developer carrier carries the developer comprises a toner concentration detector that detects a concentration of toner in the developer contained in the development device.

5. The development device according to claim 1, wherein the detector to detect whether or not the developer carrier carries the developer comprises a torque detector to detect a driving torque of the development device.

6. The development device according to claim 1, wherein the detector to detect whether or not the developer carrier carries the developer comprises an image density detector to detect an image density of a toner image formed on the image carrier.

7. The development device according to claim 1, wherein the detector to detect whether or not the developer carrier carries the developer comprises a timer to count a time period after the developer removal from the development device is started.

8. An image forming apparatus, comprising:

an image carrier on which an electrostatic latent image is formed; and a development device to develop the electrostatic latent image formed on the image carrier, the development device comprising:

a developer carrier on which developer is carried, disposed facing the image carrier;

a first developer transport path including a first transporter to transport the developer in a longitudinal direction of the development device;

a second developer transport path disposed beneath the first developer transport path, including a second transporter to transport the developer in the longitudinal direction;

a closably openable developer discharge port provided in the second developer transport path, through which the developer is removed from the development device;

a detector to detect whether or not the developer carrier carries the developer;

a driving unit to drive each of the first transporter and the second transporter in both a normal direction and a reverse direction; and a controller, the controller starting rotation of the developer carrier as well as the first transporter and the second transporter in normal directions thereof and opening the developer discharge port to remove the developer from the development device simultaneously, and starting rotation of the first transporter and the second transporter in reverse when a predetermined time period has elapsed after determining that no developer is carried on the developer carrier based on a detection result generated by the detector.

9. The image forming apparatus according to claim 8, wherein the development device further comprises a third developer transport path that is disposed beneath the first developer transport path, faces the second developer transport path, and includes a third transporter to transport the developer in the longitudinal direction, wherein the first developer transport path faces the developer carrier, and the first transporter supplies the developer to the developer carrier while transporting the developer in the longitudinal direction, the second developer transport path faces the developer carrier, and the second transporter transports the developer received from the developer carrier in the longitudinal direction, the developer discharge port is disposed in a downstream portion of the second developer transport path in a developer transport direction, and the third transporter receives the developer both from a downstream portion of the first developer transport path and from the downstream portion of the second developer transport path in the developer transport direction and transports the developer to an upstream portion of the first developer transport path.

10. The image forming apparatus according to claim 8, wherein, when the developer is removed from the development device, the controller starts rotating the image carrier before starting the rotation of the developer carrier as well as the first transporter and the second transporter in the normal directions thereof, and the controller stops rotating the image carrier when determining that no developer is carried on the developer carrier based on the detection result generated by the detector.

11. The image forming apparatus according to claim 8, wherein the detector to detect whether or not the developer carrier carries the developer comprises a toner concentration detector that detects a concentration of toner in the developer contained in the development device.

12. The image forming apparatus according to claim 8, wherein the detector to detect whether or not the developer carrier carries the developer comprises a torque detector to detect a driving torque of the development device.

13. The image forming apparatus according to claim 8, wherein the detector to detect whether or not the developer carrier carries the developer comprises an image density detector to detect an image density of a toner image formed on the image carrier.

14. The image forming apparatus according to claim 8, wherein the detector to detect whether or not the developer carrier carries the developer comprises a timer to count a time period after the developer removal from the development device is started.

15. A method of removing developer from a development device, the development device comprising:

a developer carrier disposed facing an image carrier;

a first developer transport path including a first transporter;

a second developer transport path disposed beneath the first developer transport path, including a second transporter; and a discharge port provided in the second developer transport path, the method comprising:

rotating the developer carrier as well as the first transporter and the second transporter in normal directions thereof;

opening the developer discharge port to remove the developer from the development device;

determining whether or not developer is carried on the developer carrier; and rotating the first transporter and the second transporter in reverse when a predetermined time period has elapsed after it is determined that the developer carrier is carrying no developer thereon.

16. The method of removing developer from the development device according to claim 15, further comprising:

rotating the image carrier before starting the rotation of the developer carrier as well as the first transporter and the second transporter in the normal directions; and stopping the rotation of the image carrier when it is determined that the developer carrier is carrying no developer thereon.

17. The method of removing developer from the development device according to claim 16, further comprising:

disengaging a contact member that contacts the image carrier from the image carrier.

* * * * *